US010968071B2

(12) United States Patent
Pilar et al.

(10) Patent No.: US 10,968,071 B2
(45) Date of Patent: Apr. 6, 2021

(54) METHOD OF CONTROLLING A COMPENSATOR OF THE DIFFERENCE BETWEEN THE DRAWING-OFF AND WINDING SPEEDS OF YARN WHEN WINDING YARN ON A BOBBIN AT A WORKSTATION OF A SPINNING MACHINE AND A DEVICE FOR PERFORMING THE METHOD

(71) Applicant: Maschinenfabrik Rieter AG, Winterthur (CH)

(72) Inventors: Evzen Pilar, Litomysl (CZ); Miroslav Kubes, Chocenske Predmesti (CZ)

(73) Assignee: Maschienfabrik Rieter AG, Winterthur (CH)

( * ) Notice: Subject to any disclaimer, the term of this patent is extended or adjusted under 35 U.S.C. 154(b) by 12 days.

(21) Appl. No.: 16/218,541

(22) Filed: Dec. 13, 2018

(65) Prior Publication Data

US 2019/0177110 A1 Jun. 13, 2019

(30) Foreign Application Priority Data

Dec. 13, 2017 (CZ) ..... 2017-798

(51) Int. Cl.

| | |
|---|---|
| ***B65H 59/00*** | (2006.01) |
| ***D01H 13/10*** | (2006.01) |
| ***B65H 51/20*** | (2006.01) |
| ***D01H 4/48*** | (2006.01) |

(52) U.S. Cl.

CPC ..... *B65H 59/005* (2013.01); *B65H 51/205* (2013.01); *D01H 4/48* (2013.01); *D01H 13/104* (2013.01); *B65H 2701/31* (2013.01)

(58) Field of Classification Search

CPC ..... B65H 59/005; B65H 65/00; B65H 51/20; B65H 51/205; D01H 13/104; D01H 13/10; D01H 4/50; D01H 4/48

(Continued)

(56) References Cited

U.S. PATENT DOCUMENTS 4,133,493 A * 1/1979 Schewe ..... B65H 57/003 242/154
4,356,692 A * 11/1982 Karl ..... B65H 51/205 57/263

(Continued)

FOREIGN PATENT DOCUMENTS

CZ 281250 B6 6/1992
CZ 285147 B6 5/1994

(Continued)

OTHER PUBLICATIONS

Industrial Property Office of the Czech Republic Search Report, Sep. 21, 2018.

*Primary Examiner* — Shaun R Hurley
*Assistant Examiner* — Patrick J. Lynch
(74) *Attorney, Agent, or Firm* — Dority & Manning, P.A.

(57) ABSTRACT

A method of controlling a yarn compensating arm at a workstation of a spinning machine, wherein the yarn is initially withdrawn from an intermediate vacuum storage device. Before emptying the yarn from the storage device, the compensating arm is deflected past its working and into an out-of-the-working-range position, wherein the yarn is captured by the compensating arm and also deflected to the out-of-the-working-range position to form a non-working yarn reserve. The compensating arm is retained by a force at the out-of-the-working-range position while the yarn is emptied from the storage device. Upon being emptied from the intermediate vacuum storage device, the yarn exerts a (Continued)

tensile force on the compensating arm that overcomes the retaining force causing the compensating arm to return to its working range position.

2 Claims, 3 Drawing Sheets

(58) Field of Classification Search
USPC ..... 57/31
See application file for complete search history.

(56) References Cited

U.S. PATENT DOCUMENTS 4,438,624 A * 3/1984 Mayer ..... B65H 57/14
57/261
4,969,608 A * 11/1990 Colli ..... B65H 59/36
242/486.1
5,192,032 A * 3/1993 Brouwer ..... B65H 54/20
242/413.3
5,394,684 A 3/1995 Pohn et al.
5,778,651 A * 7/1998 Spindler ..... D01H 4/50
57/263

FOREIGN PATENT DOCUMENTS

| | | | |
|---|---|---|---|
| CZ | 280089 | B6 | 10/1995 |
| CZ | 2001-4500 | | 5/2004 |
| CZ | 305860 | B6 | 4/2016 |
| EP | 2 955 142 | A1 | 12/2015 |
| WO | WO 2017/144031 | A1 | 8/2017 |

* cited by examiner

METHOD OF CONTROLLING A COMPENSATOR OF THE DIFFERENCE BETWEEN THE DRAWING-OFF AND WINDING SPEEDS OF YARN WHEN WINDING YARN ON A BOBBIN AT A WORKSTATION OF A SPINNING MACHINE AND A DEVICE FOR PERFORMING THE METHOD

TECHNICAL FIELD

The invention relates to a method for controlling a compensator of the difference between the drawing-off and winding speeds of yarn when winding yarn on a bobbin at a workstation of a spinning machine.

The invention also relates to a device for performing the compensation of the difference between the drawing-off and winding speeds of yarn wound on a bobbin at a workstation of a spinning machine.

BACKGROUND

During the winding of yarn on a cross-wound bobbin at a constant speed of the yarn being produced on a textile machine, for example, on a rotor spinning machine or an air-jet spinning machine, the yarn is periodically slackened and a yarn loop is formed. The yarn loop is formed due to traversing the yarn across the bobbin width or it is caused by different diameters of the two ends of the bobbin when winding yarn on a conical bobbin.

Due to the yarn loop formation or the slackening of the yarn, considering the constant speed of the yarn production and the constant speed of drawing-off the yarn from a spinning unit, it is necessary to compensate for this slackening of yarn by periodic lengthening and shortening the length of the yarn travel path between a draw-off mechanism and a yarn winding device. For this purpose, various compensators are used, which include a compensating arm which by one of its ends acts upon the yarn and in a desired manner extends or shortens the working path of the yarn at the workstation in the required section between the draw-off mechanism of yarn and the yarn winding device. At the same time, the compensator helps maintain a stable yarn tension, which is necessary for the correct winding of yarn on the bobbin. When restarting the yarn production process at the workstation of the textile machine after the yarn production has been interrupted, for example, after a yarn break or during the exchange of a fully wound bobbin for an empty tube, and when starting to wind a new bobbin, as shown in FIG. 1*a*, it is necessary to coordinate the start-up of the operation of the yarn loop compensator with terminating the yarn withdrawal from the intermediate storage device of yarn so as to effectively eliminate the above-mentioned yarn loop and maintain a constant tension of the yarn being wound, as shown in FIG. 1*b*.

Various solutions of spring and active magnetic compensators are known, e.g. according to CZ 281 250 B6 and CZ 305 860 B6. The compensators thus proposed have a number of advantages, in particular in terms of the speed of the reactions and the relatively large range of the swinging motion of the compensating arm, nevertheless a problem has been observed with limited controllability of the compensating arm of the compensator in certain situations, namely with respect to the specific needs of the operations and manipulations performed during transition states at the workstation, such as spinning-in yarn, a yarn break, the bobbin exchange, etc. The commencement of the operation of these compensators during the start of the spinning and winding process is then dependent on their adjustment or setting. Moreover, the active compensator must be provided with position sensors of the compensating arm so that the control unit can change its position and move it from the working area to the non-working area and vice versa, which, however, makes it impossible to maintain the simplicity of the design, the ease and the speed of setting the individual parts and the whole device.

CZ PV 2016-102 discloses a solution of a controllable electromagnetic compensator with a cylindrical magnet which is mounted rotatably about its longitudinal axis between the pole extensions of the magnet to which a control coil is assigned. Such a compensator exhibits an improvement in dynamic parameters and control but has a certain drawback which consists in limited controllability in certain specific situations, such as in the resting state when the loop compensation is not performed and when handling the compensating arm in extreme positions, etc.

CZ PV 2014-399 (CZ 305 860) describes another controllable device for eliminating a yarn loop during the process of winding yarn on a cross-wound bobbin on a spinning machine at a constant speed of yarn production, which comprises a movable compensating arm of the compensator mounted on a moving part of a controllable drive connected to a control device into which information about the position of the compensating arm and the presence of the yarn needs to be transmitted, and it is therefore necessary to equip the spinning unit with suitable sensors.

The aim of the invention is therefore to eliminate or at least reduce the disadvantages of the background art.

SUMMARY OF THE INVENTION

Additional objects and advantages of the invention will be set forth in part in the following description, or may be obvious from the description, or may be learned through practice of the invention.

The aim of the invention is achieved by a method of controlling a compensator of the difference between the drawing-off and winding speeds of yarn when winding yarn on a bobbin at a workstation of a spinning machine, whose principle consists in that before emptying an intermediate vacuum yarn storage device, the arm of the compensator is deflected across the yarn path and through its working range, to its out-of-the-working-range position, whereby the yarn is captured by the arm and is also deflected into out-of-the-working-range position, thereby forming a non-working reserve of yarn. After being deflected to the out-of-the-working-range position, the arm is held in this position by a retaining force until the intermediate vacuum storage device of yarn is emptied after the start of the yarn winding process, thereby causing the yarn to exert tensile force on the arm of the compensator and overcome the retaining force holding the arm in the out-of-the-working-range position, whereby the arm returns by the action of the yarn to its working range and operation.

The advantage of the present invention is that the start of the yarn loop compensation with the arm of the compensator is performed completely automatically and smoothly, without the need for any timing or adjustment of the moment of emptying the intermediate vacuum storage device of yarn without sensors and detectors, etc.

The principle of the device for carrying out the method consists in that the compensator arm is controllable between a fully deflected first position, a position within its working range and an out-of-the-working-range position beyond its working range, wherein a source of restraining force is assigned to the compensating arm in this out-of-the-working-range position, and the working position.

The advantage of this solution is that it enables the automatic start of the yarn loop compensator operation after consuming the yarn supply from the intermediate storage device of yarn during the start-up of the yarn winding device of the bobbin.

DESCRIPTION OF THE DRAWINGS

The invention is schematically represented in the drawing, where.

DETAILED DESCRIPTION

Figure 1A:
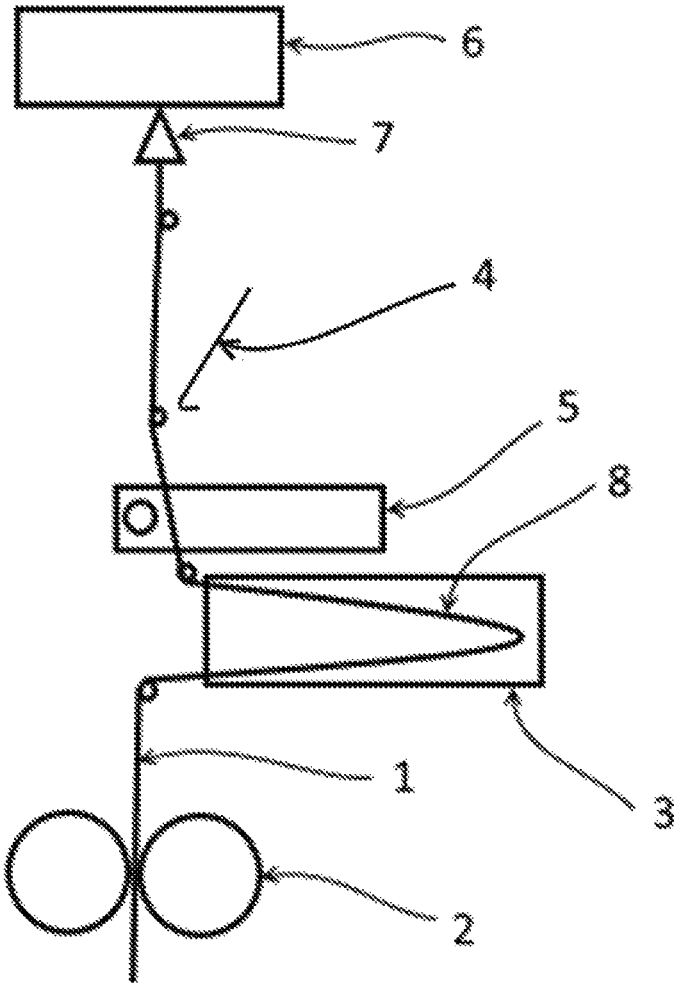
FIG. 1*a* shows an arrangement of a workstation with a compensator arm in front of the working range.

The invention will be described with reference to an exemplary embodiment of a yarn manufacturing spinning machine and with reference to the description of functions connected to this invention.

A yarn manufacturing spinning machine comprises at least one row of identical workstations arranged next to each other.

The workstation as such is well-known, and therefore will be described hereinafter only in a simplified manner without a drawing. Only those parts, elements and nodes of the workstation which are relevant for this invention will be described in greater detail.

Each workstation comprises a spinning unit (not shown) with a spinning rotor or a spinning nozzle. Yarn 1 is formed in the spinning unit. Above the spinning unit is arranged a yarn draw-off mechanism 2. The yarn draw-off mechanism 2 comprises a pair of draw-off rollers that are rotatably mounted in the machine frame, whereby one of the draw-off rollers is coupled to a drive (not shown) and constitutes a driven draw-off roller and the other draw-off roller is rotatably mounted on a swinging spring-loaded arm and constitutes a pressure roller. Both the draw-off rollers abut each other in the working position, and at the point of contact there is a nip line through which passes the yarn 1, which is withdrawn from the spinning unit during the rotation of the draw-off rollers. In the yarn path 1 downstream of the draw-off mechanism 2 is located an unillustrated winding device of yarn 1 on a cross-wound bobbin 6. The yarn winding device comprises a yarn traversing device 7, by means of which the yarn 1 is traversed across the width of the bobbin 6 during winding.

Between the draw-off mechanism 2 and the traversing device 7 of yarn, a compensator of the known yarn 1 loop is arranged at the workstation in the yarn 1 path, the compensating arm 4 of which intersects the yarn 1 path. The yarn loop compensator is mounted controllably and is reversible and swingable between its front position and rear position so as to compensate for the known yarn 1 loop which is caused by a change in the traversing speed at the edges of the wound bobbin 6 and by different diameters of a yarn 1 package when winding a conical bobbin 6. Further, in the yarn 1 working path in the region between the yarn draw-off mechanism 2 and the yarn traversing device 7 are arranged a (vacuum) intermediate yarn storage device 3 and a yarn sensor 5, e.g. a sensor of yarn presence or a sensor of the quality and presence of yarn.

Figure 1B:
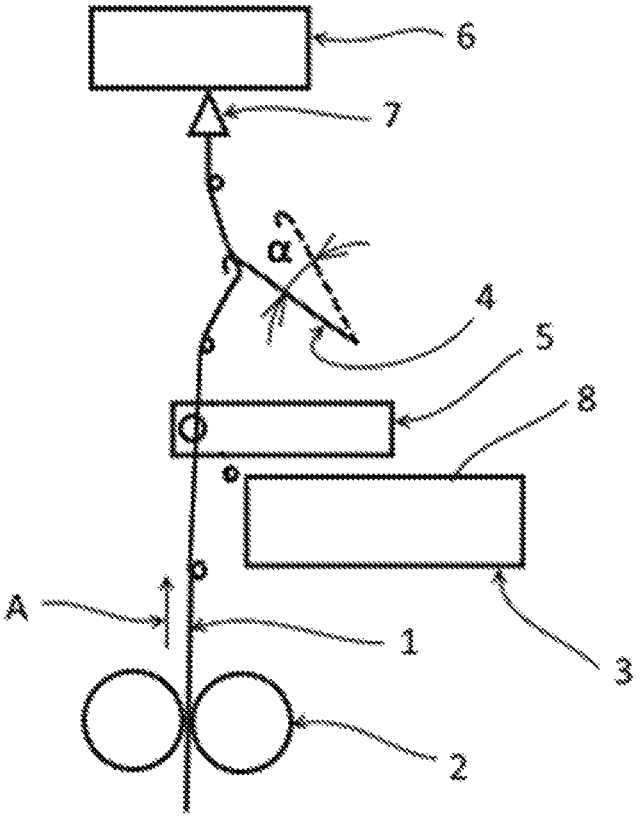
FIG. 1*b* shows an arrangement of a workstation with the compensator arm in the working range.

FIG. 1*a* is a schematic representation of a part of the workstation in the state before the start of the production operation at the workstation where the yarn 1 from the spinning unit passes between the draw-off rollers of the draw-off mechanism 2 of yarn 1 and is sucked by the vacuum into the intermediate storage device 3 of yarn 1, which a yarn reserve 8 is formed after the start of the production of yarn 1 at this workstation. The yarn 1 further passes from the intermediate storage device 3 of yarn 1 towards a traversing device 7, passing by the arm 4 of the yarn 1 loop compensator. In this state of the workstation, the compensator arm 4 is deflected in front of its working position, i.e. in front of a set of positions within the operating range of the reversibly swinging compensating arm 4 during the yarn production, whereby the state of the workstation during the yarn 1 production and with the arm 4 of the compensator in its working position is shown in FIG. 1*b*.

The device according to the invention works in such a manner that when a yarn 1 break occurs during the yarn production at the workstation of the spinning machine, information is transmitted from one of the sensors of the yarn 1 break at the workstation to the control unit and the yarn 1 production is interrupted at the respective workstation, i.e. the process of winding yarn on the bobbin 6 is stopped, and the feed of fibrous material to the spinning unit, the spinning process in the spinning unit, and the operation of the draw-off mechanism 2, etc., are stopped as well. The compensating arm 4 of the compensator moves to the fully deflected first position D, in which it does not hamper handling the yarn at the workstation and in which its end does not act on the yarn.

In preparation for the production process, the end of the broken yarn 1 is found, the required yarn 1 length necessary for successful spinning-in is unwound and fed between the draw-off rollers of the draw-off mechanism 2 and to the spinning device to a position in which the spinning-in end of yarn 1 is ready for spinning-in, Subsequently, the yarn reserve 8 is deposited in the intermediate vacuum storage device 3 of yarn 1.

Following the depositing of the yarn 1 reserve into the intermediate vacuum storage device 3 of yarn 1, the compensating arm 4 moves from its fully deflected first position over its working area defined by the angle $\alpha$ to the out-of-the-working-range position B, whereby during its motion, it captures with its end the yarn 1 which was brought in the previous steps between the yarn traversing device 7, the intermediate vacuum storage device 3 of yarn 1 and the yarn draw-off mechanism 2, thereby creating already at that moment a known, substantially triangular, compensation reserve of yarn 1 at the workstation, which however, has a greater overall length than the known substantially triangular compensation reserve of yarn 1 during yarn production 1 at the workstation where the compensating arm 4 performs a reversibly swinging motion within its working area defined by the angle $\alpha$. After the deflection of the compensating arm 4 to the out-of-the-working-range position B, the compensating arm 4 is held in this position by a source of the retaining force F and the yarn 1 is stretched over the end portion of the compensating arm 4. The displacement of the compensating arm 4 between different positions is performed, for example, by a service robot (especially in the case of a spring compensator) or by a drive of the compensating arm 4, formed either by an electric motor or by an electromagnet, etc., and controlled by a control device. Maintaining the compensating arm 4 in the out-of-the-working-range position B with the yarn stretched over the working end of the compensating arm 4, i.e. exerting the retaining force F, as will be described in detail below, is performed either by a suitable stop or by appropriate control of the electric motor or by electrical impulse to the control electromagnet. The source of the force F is associated with the compensator and/or is located at the workstation of the spinning machine.

When the production process of yarn 1 is restarted at the workstation, the winding of the yarn 1 on the bobbin 6 begins, when the yarn 1 is traversed by the traversing device 7 across the width of the bobbin 6 and the yarn 1 is withdrawn from the intermediate vacuum storage device 3 of yarn 1. As a result, the yarn 1 reserve stored in the intermediate vacuum storage device 3 of yarn 1 is consumed. At the same time, the yarn 1 moves across the working end of the compensating arm 4, which is still held in its out-of-the-working-range position B. During this, the tension in the yarn 1 induced by in the intermediate (vacuum) storage device 3 of yarn 1 is smaller than the retaining force F of the compensating arm 4 in its out-of-the-working-range position B (tension in the yarn 1 induced by the vacuum in the (vacuum) intermediate storage device 3 of yarn 1 does not overcome the retaining force F) and therefore the yarn 1 reserve of the intermediate vacuum storage device 3 of yarn 1 is consumed by winding yarn on the bobbin while the compensating arm 4 remains in the above-mentioned out-of-the-working-range position B in which it does not perform the compensation of the yarn 1 and the yarn 1 wound on the bobbin 6 only passes through it, as indicated by the dashed lines in FIG. 2. Due to the action of the vacuum in the yarn 1 storage device 3, the tension maintained in the yarn 1 is sufficient to suppress possible slackening of the yarn 1 (yarn surplus) during winding it on the bobbin 6 in this early stage of the start of the yarn manufacturing process.

Figure 2:
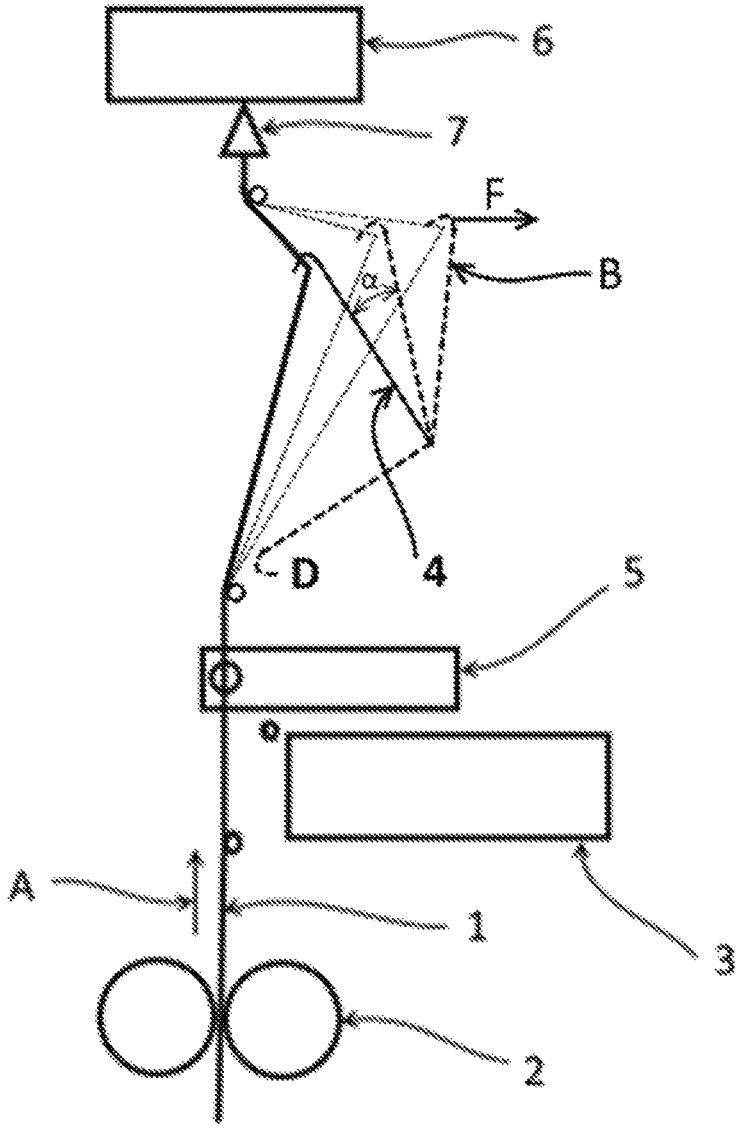
FIG. 2 shows an arrangement of a workstation according to the invention with the arm of the yarn loop compensator in the out-of-the-working-range position.

As soon as the yarn 1 reserve 8 in the intermediate (vacuum) storage device 3 of yarn 1 is consumed, the vacuum from the storage device 3 stops acting on the yarn 1 and the tension in the yarn 1 is increased. Consequently, the yarn 1 deflects the compensating arm 4 of the compensator from the out-of-the-working-range position B to the working area indicated by the angle α when compensating for the yarn 1 loop during yarn 1 production, as shown in FIG. 2, whereupon the yarn 1 overcomes the retaining force F of the compensating arm 4 in the out-of-the-working-range position B and the compensating arm 4 is moved due to the action of the yarn 1 from its out-of-the-working-range position B to its working area indicated by the angle α and at the same time the compensation activity of the compensating arm 4 of the compensator is completely resumed during the yarn production 1. The end positions of the path of the yarn 1 stretching across the working end of the compensating arm 4 during compensation in the working area defined by the angle α, are indicated by the full and dotted lines in FIG. 2.

The source of the retaining force F acting on the compensating arm 4 may be configured internal to the compensating arm 4, external to the compensating arm 4, or partially internal to the compensating arm 4 and partially on the spinning machine external to the compensating arm 4.

This means that due to the specific arrangement of the individual elements and the balance between them, the compensating arm 4 of the compensator of yarn 1 takes over smoothly and automatically the compensation of the yarn 1 loop from the (vacuum) intermediate storage device 3 of yarn 1, without the need for timing or detecting this moment with the aid of other technical means, such as sensors of yarn tension and presence, etc.

During controlled stopping of the production process at the workstation when there is not a yarn 1 break, the compensating arm 4 of the compensator moves to the out-of-the-working-range position B and the yarn 1 is stretched across its end (working) portion. After resuming the production process as a result of increased tension in the yarn 1, the compensating arm 4 of the compensator moves from the out-of-the-working-range position B to the working area indicated by the angle α, where it performs the compensation of the yarn 1 during winding the bobbin 6.

In one embodiment, after the entire length of the yarn 1 reserve 8 has been withdrawn from the intermediate (vacuum) storage device 3 of yarn 1, the travel path of the yarn 1 between the draw-off mechanism 2 and the arm 4 of the compensator changes, and, as a result, the yarn 1 enters the detection zone of the sensor 5 of the presence of yarn 1 which transmits this information to the control unit controlling respective operations of the downstream nodes of the workstation. In another example of embodiment, the sensor of the transition of the compensating arm 4 to its working area indicated by the angle α is assigned directly to the compensator or to the compensating arm 4, or it is formed by an inner sensor of the drive of the compensating arm 4, etc.

INDUSTRIAL APPLICABILITY

The invention can be used during the operation of workstations of yarn manufacturing textile machines.

Modifications and variations can be made to the embodiments illustrated or described herein without departing from the scope and spirit of the invention as set forth in the appended claims.

The invention claimed is:

1. A method of controlling a compensator of a difference between drawing-off and winding speeds of yarn when winding yarn on a bobbin at a workstation of a spinning machine, the compensator comprising a compensating arm movable between different positions at different stages of operation at the workstation, as well as during service operations at the workstation following filling and emptying of the yarn from an intermediate vacuum storage device at the workstation, the method comprising:

before emptying the yarn from the intermediate vacuum storage device, deflecting the compensating arm over a working range thereof across a path of the yarn and into an out-of-the-working-range position of the compensating arm, wherein the yarn is captured by the compensating arm and is also deflected with the compensating arm to the out-of-the-working-range position thereby forming a non-working reserve of yarn;

maintaining the compensating arm at the out-of-the-working-range position with a retaining force while emptying the yarn from the intermediate vacuum storage device; and wherein upon emptying the intermediate vacuum storage device, the yarn exerts tensile force on the compensating arm that overcomes the retaining force such that the compensating arm returns from the out-of-the-working-range position to the working range and resumes operation.

2. The method according to claim 1, further comprising changing the retaining force before complete emptying of the yarn from the intermediate vacuum storage device.

* * * * *